US005155312A

United States Patent [19]

Hashimoto et al.

[11] Patent Number: 5,155,312

[45] Date of Patent: Oct. 13, 1992

[54] PUFFER TYPE GAS CIRCUIT INTERRUPTER

[75] Inventors: Akira Hashimoto, Hitachi; Youichi Ohshita, Katsuta; Kogi Ishikawa, Mito; Masanori Tsukushi; Yukio Kurosawa, both of Hitachi, all of Japan

[73] Assignee: Hitachi, Ltd., Tokyo, Japan

[21] Appl. No.: 668,128

[22] Filed: Mar. 12, 1991

[30] Foreign Application Priority Data

Mar. 13, 1990 [JP] Japan ..... 2-060014

[51] Int. Cl.[5] ..... H01H 33/70; H01H 33/88

[52] U.S. Cl. ..... 200/148 A; 200/150 G

[58] Field of Search ..... 200/148 R, 148 A, 148 B, 200/150 G

[56] References Cited

U.S. PATENT DOCUMENTS

| | | | |
|---|---|---|---|
| 3,668,352 | 6/1972 | Teijeiro | 200/148 R |
| 3,708,639 | 1/1973 | Vigreux et al. | 200/148 R |
| 3,816,684 | 6/1974 | Teijeiro | 200/148 A |
| 4,320,270 | 3/1982 | Graf et al. | 200/148 A |
| 4,471,188 | 9/1984 | Van et al. | 200/148 A |
| 4,716,266 | 12/1987 | Muscaglione et al. | 200/148 R |
| 4,939,322 | 7/1990 | Kashimura et al. | 200/148 A |

FOREIGN PATENT DOCUMENTS

| | | |
|---|---|---|
| 60-150521 | 8/1985 | Japan . |
| 61-206126 | 9/1986 | Japan . |

*Primary Examiner*—J. R. Scott

*Attorney, Agent, or Firm*—Antonelli, Terry, Stout & Kraus

[57] ABSTRACT

An interrupter including a gas pressurizer for pressurizing a gas to flow toward a forward end of at least one contact of the interrupter, and a first orifice forming a first space with the forward end of the at least one contact for passing the gas pressurized by the gas pressurizer when a flow of electric current is interrupted. A second orifice forms a second space with the at least one contact for passing the gas which passed through the first orifice, with a chamber being formed between the first and second orifices. The chamber has an inner diameter greater than an inner diameter of the first and second orifices. At least one pressurized gas passage is provided through which a portion of the pressurized gas is supplied to the chamber without passing the first orifice so that the pressurized gas supplied to the chamber through the pressurized gas passage flows to the first space formed by the forward end of the at least one contact and the first orifice.

9 Claims, 4 Drawing Sheets

PUFFER TYPE GAS CIRCUIT INTERRUPTER

THE FIELD OF THE INVENTION

The present invention relates to a nozzle used in a gas blast circuit breaker, and more particularly to a nozzle suitable for a puffer-type gas circuit breaker.

BACKGROUND OF THE INVENTION

In a conventional gas blast circuit breaker, an arc-extinguishing gas is simultaneously compressed upon an opening motion of contacts, and the compressed gas is directed by a throat portion of an insulated nozzle toward an arc generated by the electric current breaking operation between the separated contacts. A flow speed of the compressed gas is accelerated at the throat portion so that the flow speed thereof at a downstream side of the throat portion becomes subsonic or supersonic. When the throat portion is moving toward the outside of a stationary contact on which the high flow speed gas passes, a gas pressure at a part of a forward end of the stationary contact becomes transiently less than a filling gas pressure in the breaker, although a strength of electric field at the forward end of the stationary contact is high. Therefore, an electrical, insulating resistance between the contacts is decreased largely, and a small capacitive current interrupting characteristic, which is important when a distance between the contacts is small and the electric field strength between the contacts is large after the electric current is broken, particularly just after the throat portion has moved to the outside of the stationary contact, is deteriorated.

In a conventional gas blast circuit breaker as disclosed in Japanese Patent Unexamined Publication No. 60-150521, the gas blast circuit breaker has a reflection surface at a gas flow downstream side of a throat portion of an insulated nozzle to reflect the gas flow toward a stationary contact after the gas passes through the throat portion, so that a decrease in pressure at a forward end of the stationary contact is prevented and an electrical insulating resistance between the contacts is improved.

In a conventional gas blast circuit breaker as disclosed in Japanese Patent Unexamined Publication No. 61-206126, the gas blast circuit breaker has a bypass hole connecting an upstream side of a throat portion of an insulated nozzle to a downstream side thereof so that a high temperature gas in the upstream side of the throat portion is discharged through the bypass hole to accelerate a recovery of an insulating resistance between the contacts and the gas is directed toward the stationary contact to improve the insulating resistance between the contacts.

SUMMARY OF THE INVENTION

The object of the present invention is to provide a nozzle for interruptor contacts, in which a gas pressure is maintained at a high level over substantially an entire range of a forward end of the contact when an electric current is cut off by the contacts.

According to the present invention, a nozzle for interrupter contacts comprises gas pressurizing means for pressurizing a gas flowing toward a forward end of a contact of the interrupter, with a first orifice forming a first space with a forward end of the contact for passing the gas pressurized by the gas pressurizing means when an electric current is cut off. A second orifice forms a second space with the contact passing the gas which passed through the first orifice, with a chamber being formed between the first orifice and the second orifice. The chamber has an inner diameter larger than an inner diameter of the first and second orifices. At least one pressurized gas passage is provided through which a part of the pressurized gas is supplied to the chamber without passing the first orifice so that the pressurized gas supplied to the chamber through the pressurized gas passage flows into the first space formed by the forward end of the contact and the first orifice.

In the present invention, the nozzle 4 of the interrupter contacts, comprises a second orifice forming a second space with the contact for passing the gas which passed through the first orifice, with a chamber, formed between the first orifice and the second orifice and having an inner diameter larger than an inner diameter of the first and second orifice. A portion of the pressurized gas, supplied to the chamber or stored by the chamber, passes through a pressurized gas passage without passing the first orifice so that the pressurized gas supplied to the chamber through the pressurized gas passage flows into the first space formed by the forward end of the contact and the first orifice. The pressurized gas is supplied to the first space from upstream and downstream sides of the first space so that a decrease in pressure at a part of the forward end of the contact by the high flow speed of gas is prevented. Therefore, the gas pressure is maintained at a high level over substantially the entire range of the forward end of the contact and an electrical insulating resistance between the contact is securely maintained when an electric current is broken by a disengagement of the contacts.

DETAILED DESCRIPTION

Figure 1:
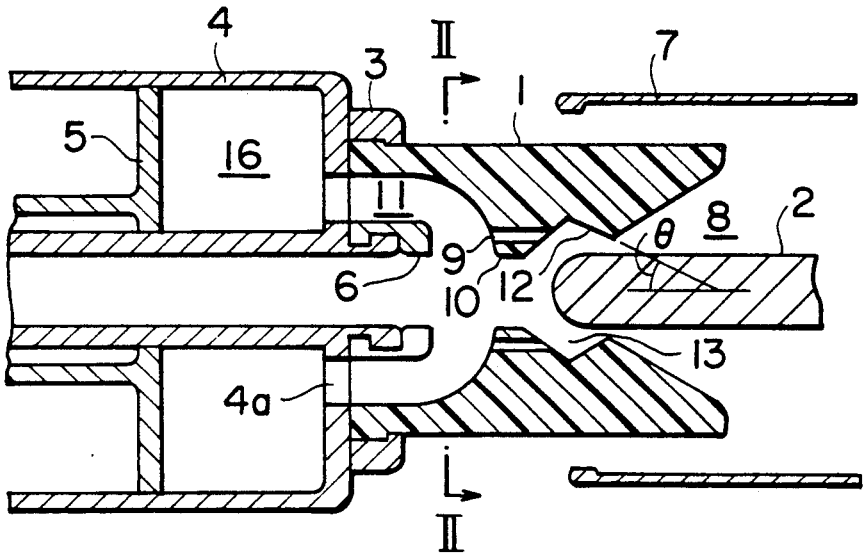
FIG. 1 is a cross-sectional view of a first embodiment of the present invention.

As shown in FIG. 1, a supported piston 5 has a puffer cylinder 4 fitted thereon, with the piston 5 being adapted to slide in the puffer cylinder 4 to form a compressor 16. The construction shown in FIG. 1 is received by a hermetically sealed container (not shown)

filled by an arc-extinguishing gas, with the arc-extinguishing gas being compressed by an operation of the compressor 16. An insulated nozzle surrounds the plurality of apertures 4a of the puffer cylinder 4, a movable main contact is mounted on the outside of the insulating nozzle 1, and a movable arc-contact 6 is mounted on the inside of the insulated nozzle 1.

The movable main contact is adapted to contact a stationary main contact to form a main contact pair, and a stationary contact 2 is adapted to be inserted into the movable arc-contact through a throat portion 10 of the insulated nozzle 1 to form a pair of arc contacts 2, 6. The main contact pair cuts off an electric current or the main contacts separate from each other before the arc contact pair breaks the electric current, and the main contact pair provides an electric current flow or the main contacts contact with each other after the arc contact pair provides a flow of the electric current.

The insulated nozzle 1 has the throat portion 10 for increasing a flow speed of the compressed gas, a reflection surface 12 arranged in a diameter expansion chamber 13 at a downstream side 8 of the throat portion 10, and at least one gas passage 9 for enabling a flow of the compressed gas from an upstream side 11 of the throat portion 10 into the chamber 13 toward the reflection surface 12.

When the flow of electric current is desired to be broken, an interruptor movable part including the puffer cylinder 4 is moved toward the left in FIG. 1 so that the arc-extinguishing gas in the compressor 16 is compressed, the main contacts 3 and 7 separate from each other and, subsequently, the arc contacts 2 and 6 separate from each other. After the throat portion 10 has moved to the outside of the forward end of the stationary arc contact 2 as shown in FIG. 1, the arc extinguishing gas compressed in the compressor 16 flows to the downstream side 8 of the throat portion 10 through the aperture 4a and the upstream side 11 of the throat portion 10 so that an arc generated by the separation of the arc contacts 2 and 6 is extinguished by the arc extinguishing gas.

Figure 4:
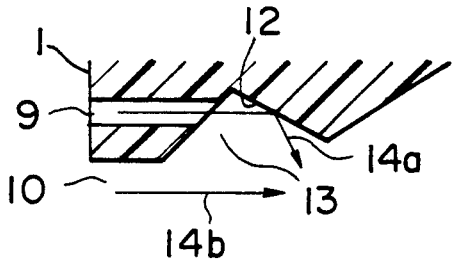
FIG. 4 is a cross-sectional view of a flow condition of the pressurized gas in the embodiment of FIG. 1.

As shown in FIG. 4, a part of the arc extinguishing gas is supplied to the chamber 13 from the upstream side 11 through the gas passage 9 directing the gas toward the reflection surface 12 for directing the gas toward the stationary arc contact 2, before the throat portion 10 is positioned at the outside of the forward end of the stationary arc contact 2 as shown in FIG. 1. Therefore, the arc extinguishing gas is supplied to a space between the throat portion 10 and the forward end of the stationary arc contact 2 from both sides of that space, that is, from the throat portion and from the chamber 13 so that a pressure of the arc extinguishing gas over substantially the entire range of the forward end of the stationary arc contact 2 is maintained at a high level and the electrical insulating resistance between the arc contacts 2 and 6 is maintained at a high level. As a result, it is possible to improve the breaking ability of small capacitive current.

Figure 7:
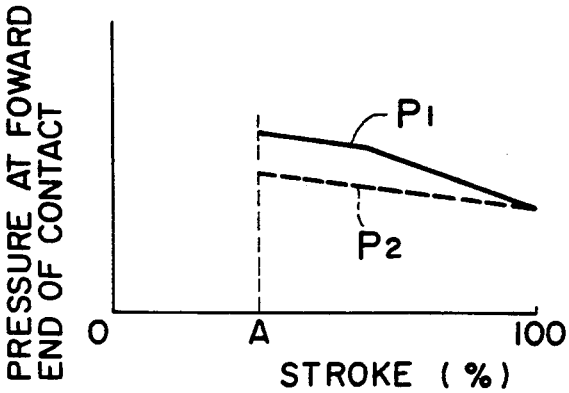
FIG. 7 is a graphical illustration of the relationship between a position of the nozzle and a pressure at the forward end of the stationary contact.

FIG. 7 graphically depicts the relationship between a stroke position of the throat portion 10 and the pressure at the forward end of the stationary arc contact 2. A line P1 represents the relationship of the embodiment of FIG. 1 and a line P2 represents the relationship of the prior art. As shown in FIG. 7, the pressure P1 at the forward end of the stationary arc contact 2 is 30% greater than that P2 in the prior art, particularly from a start of separation A of the arc contacts 2 and 6 to a middle of the stroke of the throat portion 10 so that electrical insulating resistance between the arc contacts 2 and 6 in the present invention embodiment is improved in comparison with the prior art. A relationship between an arc extinguishing gas flow 14a flowing through the gas passage 9 and an arc extinguishing gas flow 14b flowing through the throat portion 10 is varied by, for example, changing an angle $\theta$ of the reflection surface 12 in relation to a central axis of the arc contacts 2 and 6, changing a number of the gas passage 9, or changing an area of the gas passage 9.

Figure 2:
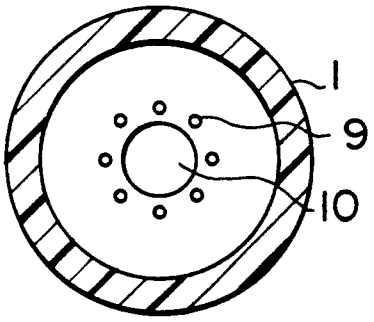
FIG. 2 is a cross-sectional view taken along the line II—II in FIG. 1.
Figure 3:
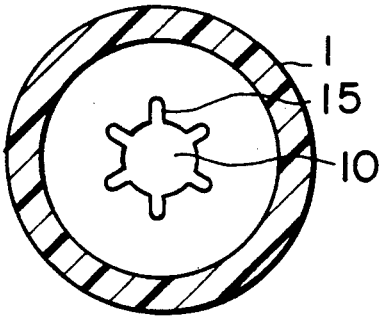
FIG. 3 is a cross-sectional view of a modification of a pressurized gas passage according to the present invention.

As shown in FIG. 2, arrangement of a plurality of the gas passages 9 may surround the throat portion 10 and, as shown in FIG. 3, the plurality of the gas passages 9 may be fashioned as slits 15 extending radially outwardly from the throat portion 10. Circumferential distances between the gas passages 9 adjacent to each other need not be constant. If the gas passages 9 extend parallel to a central axis of the nozzle 1, the gas passages 9 may be formed easily from a large opening at the left side of the nozzle 1 shown in FIG. 1. It is necessary for the gas passage 9 to supply the pressurized gas to the chamber 13 without passing through the throat portion 10.

Figure 5:
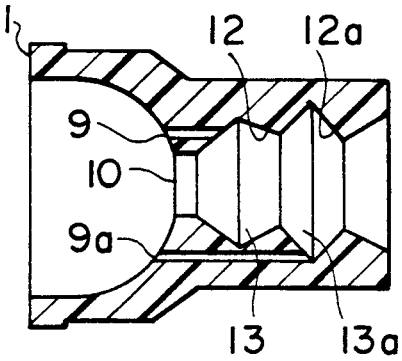
FIG. 5 is a cross-sectional view of another embodiment of the present invention.

An additional chamber 13a (FIGS. 5, 6) may be arranged at a downstream side of the chamber 13. The additional chamber 13a includes an additional reflection surface 12a for directing toward the stationary arc contact 2 the gas flow supplied into the additional chamber 13a. At least one additional gas passage 9a (FIG. 5) is arranged at the radially outside of the gas passage 9 to connect the compressor 16 to the additional chamber 13a so that the pressurized gas is supplied to the additional chamber 13a without passing the throat portion 10 and the chamber 13. Therefore, the pressurized gas is supplied to the space between the forward end of the stationary arc contact 2 and the throat portion 10 from both of the chamber 13 and the additional chamber 13a when the nozzle 1 is moved away from the stationary arc contact 2 to interrupt the flow of electric current. An additional orifice portion is formed between the chamber 13 and the additional chamber 13a to decrease the gas flow from the chamber 13 to the additional chamber 13a and to increase the gas flow speed passing through the additional orifice portion for strongly blowing the forward end of the stationary arc contact 2.

When the nozzle 1 is moved further from the positional relationship of the stationary arc contact 2 and the nozzle 1 shown in FIG. 1 and passes the additional orifice portion 9, the pressurized gas is supplied to a space between the forward end of the stationary arc contact 2 and the additional orifice portion 9 from the chamber 13 through the additional orifice portion 9 and from the additional chamber 13a. Therefore, the pressure of the arc extinguishing gas is maintained at a high level over substantially the entire range of the forward end of the stationary arc contact 2.

Figure 6:
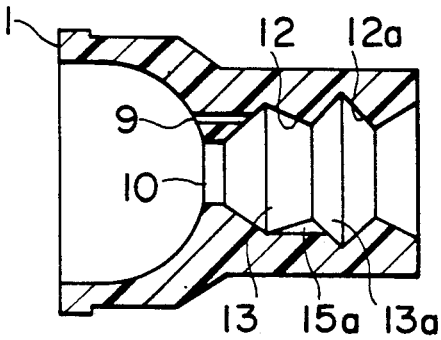
FIG. 6 is a cross-sectional view of yet another embodiment of the present invention.

As shown in FIG. 6, at least one additional gas passage 15a extending radially outwardly from the additional orifice portion 9 connects the chamber 13 to the additional chamber 13a so that the pressurized gas supplied to the chamber 13 through the gas passage 9 flows into the additional chamber 13a and the pressurized gas supplied to the chamber 13 through the throat portion 10 flows into the additional chamber 13a. Therefore, the pressurized gas is supplied to the space between the forward end of the stationary arc contact 2 and the throat portion 10 from both of the chamber 13 and the additional chamber 13*a*. When the nozzle 1 is moved further from the positional relationship of the stationary arc contact 2, and the nozzle 1 shown in FIG. 1 and passes the additional orifice portion 9, the pressurized gas is supplied to the space between the forward end of the stationary arc contact 2 and the additional orifice portion 9 from the chamber 13 through the additional orifice portion and from the additional chamber 13*a*. Therefore, the pressure of the arc extinguishing gas is maintained at a high level over substantially the entire range of the forward end of the stationary arc contact 2.

The present invention can be applied to a different-type nozzle for a gas blast circuit breaker, in which the nozzle 1 receives a main contact which is adapted to contact the stationary contact 2 to transmit a significantly large of the electric current, and the stationary contact 2 is adapted to contact both the main contact and the arc movable contact 6.

Figure 8:
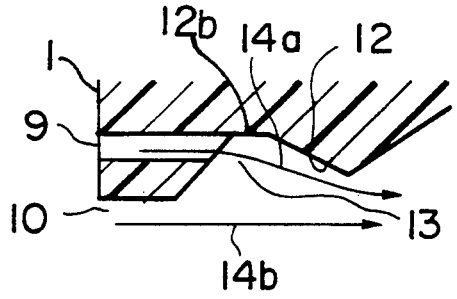
FIG. 8 is a cross-sectional view of a further embodiment of the present invention.
Figure 9:
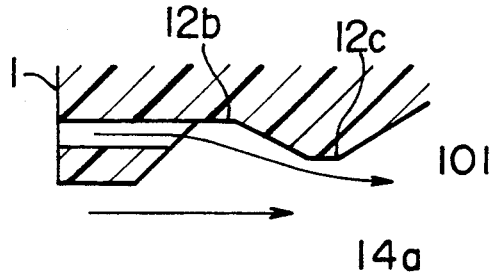
FIG. 9 is a cross-sectional view of a still further embodiment of the present invention.
Figure 10:
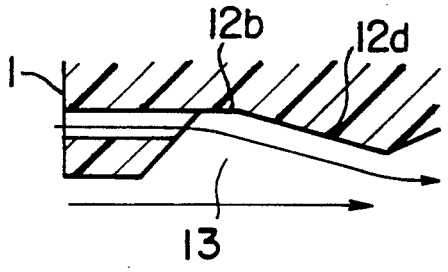
FIG. 10 is a cross-sectional view of yet another embodiment of the present invention.

As shown in FIGS. 8–10, a cylindrical surface 12*b*, extending substantially parallel to a longitudinal axis of the stationary arc contact 2 may be arranged between the reflection surface 12 and the throat portion 10. As shown in FIG. 9, a further cylindrical surface 12*c*, extending substantially parallel to the longitudinal axis of the stationary arc contact may be arranged upstream of the reflection surface 12, or, as shown in FIG. 10, a reflection surface 12*d* may be arranged at an angular inclination differing from the embodiment of FIG. 8.

Figure 11:
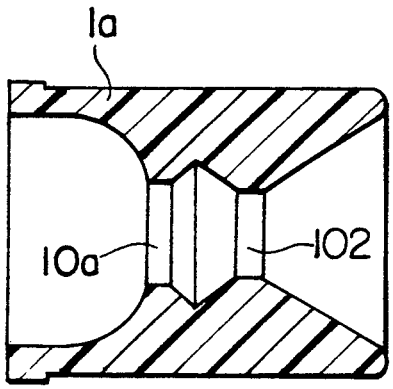
FIG. 11 is a cross-sectional view of a further embodiment of the present invention.
Figure 12:
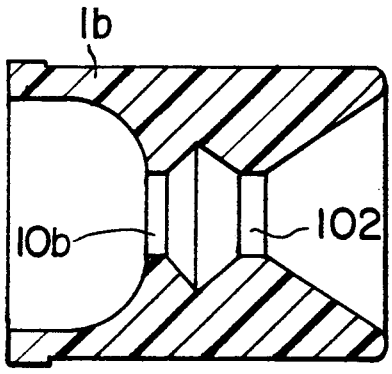
FIG. 12 is a cross-sectional view of a still further embodiment of the present invention.

Alternatively, as shown in FIGS. 11 and 12, if an inner diameter of a throat portion 10*a* of a nozzle 1*b* is substantially equal to (FIG. 12) or a throat portion 10*b* of a nozzle 10*a* (FIG. 11) is larger than an inner diameter of the additional orifice portion 102, the pressure of the gas over substantially the entire range of the forward end of the stationary arc contact 2 is maintained so as to be slightly larger in comparison with the prior art constructions.

What is claimed is:

1. An interrupter comprising:

a pair of contacts adapted to be separated from each other so as to interrupt an electrical current flow therebetween and to contact each other for allowing an electrical current flow therebetween, at least one of the contacts including a forward end facing the other contact when the pair of contacts are separated from each other;

a gas for extinguishing an arc formed between the contacts when the pair of contacts are separated from each other;

gas pressurizing means for pressurizing the gas to the forward end of the at least one contact;

a first orifice forming a first space with the forward end of the at least one contact for passing the gas pressurized by the gas pressurizing means when the flow of electric current is interrupted;

a second orifice forming a second space with said at least one contact for passing the gas which passed through the first orifice;

a chamber formed between the first and second orifices, said chamber having an inner diameter larger than an inner diameter of the first and second orifices; and at least one pressurized gas passage through which a portion of the pressurized gas is supplied to the chamber without passing the first space after the pair of contacts are separated from each other so that the pressurized gas supplied to the chamber through the pressurized gas passage flows into the first space formed by the forward end of said at least one contact and the first orifice.

2. An interrupter according to claim 1, wherein the chamber includes a reflection surface facing the at least one contact and the pressurized gas passage for directing the gas flow from the pressurized gas passage to the at least one contact.

3. An interrupter according to claim 1, wherein the pressurized gas passage includes at least one hole arranged at a position radially outwardly of the first orifice.

4. An interrupter according to claim 1, wherein the pressurized gas passage includes at least one slit extending radially outwardly from the first orifice.

5. An interrupter according to claim 1, further comprising:

a third orifice forming a third space with the at least one contact for passing the gas which passed through the second orifice, and a second chamber formed between the second orifice and the third orifice, said second chamber having an inner diameter larger than an inner diameter of the second and third orifices.

6. An interrupter according to claim 1, further comprising:

at least one second pressurized gas passage through which a portion of the pressurized gas is supplied to the second chamber without passing through the first orifice and the second orifice so that the pressurized gas applied to the second chamber through the second pressurized gas passage flows to a space formed by the forward end of the at least one contact and the second orifice.

7. An interrupter according to claim 1, further comprising:

at least one second pressurized gas passage communicatable with the chamber and the second chamber.

8. A nozzle according to claim 2, wherein the chamber includes a surface extending substantially parallel to a longitudinal surface of the at least one contact between the reflection surface and the first orifice.

9. An interrupter according to claim 1, wherein an opening area of the first space is less than an opening area of the second space when the forward end of the at least one contact is arranged in the first orifice.

* * * * *